US007736145B1

(12) United States Patent
Horvath et al.

(10) Patent No.: US 7,736,145 B1
(45) Date of Patent: Jun. 15, 2010

(54) CANDLE WICK STRAIGHTENING METHOD AND APPARATUS

(76) Inventors: Daivid G. Horvath, 2163 Saucon Ave., Bethlehem, PA (US) 18015; Brian Gallagher, 8000 Salem Bible Church Rd., Macungie, PA (US) 18062

( * ) Notice: Subject to any disclaimer, the term of this patent is extended or adjusted under 35 U.S.C. 154(b) by 48 days.

(21) Appl. No.: 10/138,022

(22) Filed: May 3, 2002

(51) Int. Cl.
*F23D 3/34* (2006.01)

(52) U.S. Cl. ..... 431/291; 431/292; 431/120; 431/301; 431/322; 264/247

(58) Field of Classification Search ..... 431/289, 431/288, 291, 292, 126, 120, 301, 311, 320, 431/321, 322; 264/255, 259, 271.1, 277, 264/294, 245, 247, 263, 267, 268, 275; 425/803, 425/110
See application file for complete search history.

(56) References Cited

U.S. PATENT DOCUMENTS

| | | | | | |
|---|---|---|---|---|---|
| 1,782,025 | A | * | 11/1930 | Bell et al. | 431/149 |
| 2,512,885 | A | * | 6/1950 | Archambeau | 431/321 |
| 2,520,682 | A | | 8/1950 | Harrison et al. | |
| 3,702,495 | A | * | 11/1972 | Renoe | 264/319 |
| 3,724,982 | A | * | 4/1973 | Davis | 425/803 |
| 3,730,674 | A | | 5/1973 | Gross | 431/288 |
| 3,752,433 | A | | 8/1973 | Berman | 249/94 |
| 3,759,478 | A | | 9/1973 | Scmitt et al. | 249/93 |
| 3,799,492 | A | | 3/1974 | O'Laughlin | 249/94 |
| 3,831,899 | A | | 8/1974 | Doig | 249/97 |
| 3,925,029 | A | | 12/1975 | Wilson | 44/7.5 |
| 3,998,922 | A | | 12/1976 | Weiss | 264/255 |
| 4,004,773 | A | | 1/1977 | Binder | 249/93 |
| 4,126,408 | A | * | 11/1978 | Cox | 431/320 |
| 4,134,718 | A | * | 1/1979 | Kayfetz et al. | 431/125 |
| 4,781,577 | A | * | 11/1988 | Stewart | 431/320 |
| 5,939,005 | A | | 8/1999 | Materna | 264/255 |
| 6,090,331 | A | | 7/2000 | Schwarz et al. | 264/405 |
| 6,151,767 | A | | 11/2000 | Gross | 29/428 |

FOREIGN PATENT DOCUMENTS

DE 28 31 218 A1 * 1/1980

* cited by examiner

*Primary Examiner*—Steven B McAllister
(74) *Attorney, Agent, or Firm*—Clinton H. Wilkinson; Charles A. Wilkinson

(57) ABSTRACT

A method and apparatus for inserting wicks into candles formed in jars or containers characterized by a device comprised of a hollow tube, sealed on one end, in which a wick and wick base can snugly fit, and a crosspiece having width greater than width of the mouth of a jar so that after candle wax is poured, the wick straightening device is inserted into the jar and is removed after the wax has cooled so that the wick will remain straight even after the candle wax has cooled.

3 Claims, 4 Drawing Sheets

CANDLE WICK STRAIGHTENING METHOD AND APPARATUS

BACKGROUND OF THE INVENTION

1. Field of the Invention

The present invention relates to making candles. More particularly, this invention relates to a method of easily and efficiently inserting a wick into a candle being formed in a jar-type container, and more particularly still to an apparatus and method for maintaining a candle wick straight and centered while the liquid fuel or wax is being poured and is cured.

2. Preliminary Discussion

The word candle derives from the Latin 'Candere,' meaning to flicker or glitter. Prior to about 1825, candles were comprised of a single stranded wick, rather than a braided wick, and therefore burned very unevenly. The introduction of paraffin wax as a cheaper replacement for beeswax as a liquid fuel in the $19^{th}$ century, as well as the development of means for mass producing of candles, resulted not only in candles becoming common in most households but also made them available in a variety of shapes and sizes.

While such improvements have enabled candle makers to produce candles which are longer lasting and burn more evenly, a continuing challenge for candle makers who manufacture candles ready made in glass jars or other types of containers remains keeping the wick straight during the curing process. Candles produced in closed bottom containers often use wicks incorporating a thin piece of metal running through the core as an anchor and reinforcement for said wick. However, when molten candle wax is poured, it cools and changes from a liquid state to a solid state in an uneven pattern, with more shrinking occurring in the center area of the container than along the sides, leaving the solidified candle with a more or less semi-hollowed out core. This uneven shrinking pattern causes the wick to very frequently become displaced from the center of the container so that it is not only no longer straight, but may even have been displaced so far to the side that it juts out of the wall of the hollowed out portion of the core. When a second round of wax is added to the candle, to fill in the core, it will tend to retain whatever unevenness or curvature that has been imparted to it. If the operator or pourer furthermore attempts to straighten the wick by hand adjustment, between the first and second pours only the top portion of the wick is likely to be affected, leaving any unevenness in the lower portions where it will affect the burning of the candle as it burns down. There is a critical time during which the wick must be inserted into a candle, since the wick will only be able to be inserted when the wax is in its molten state. Thus, there remains a need for an apparatus and method for maintaining a candle wick in a candle jar or container straight and centered in the container during the pouring of liquid fuel such as paraffin into the container.

The present inventor has solved the problem of maintaining straight wicks in candles formed in jars and the like by providing a straight tube having a sealed top into the lower end of which a wick is placed. The wick tube is then placed in molten wax in the jar and supported on the lip of the jar by a sliding crosspiece. A normal bottom anchor is attached to the bottom of the wick to secure it in the wax. After solidification of the wax, the wick tube or sleeve is withdrawn from the solidified wax, leaving a straight wick in a relatively straight orifice, which can then be filled with molten wax in a second pour. Wax is excluded from the tube during solidification of the wax by air trapped in the tube. Relatively little sideways force is applied to the wick during the second pour so it remains relatively straight even though no longer contained in the straight tube of the invention.

3. Description of Related Art

While candles are no longer required for light in this modern age of electricity, as they were by the Ancient Egyptians and Romans, and during the Middle Ages, candles are still widely used for ornamental and decorative purposes. Candle makers have created many styles and kinds of new candles that come in an assortment of shapes, colors and designs. A very common practice now is forming or making candles in glass jars or containers. These self-enclosed candles allow users to neatly burn them without the need for candlesticks and enable users to move them around more easily. However, these candles have posed a problem for candle makers during the pouring process because they are not able to keep the wick straight in the same manner as is used for candles not contained in a jar or container. Consequently, new devices and methods have been developed to try to overcome the problem of wick straightness. However, none of the related art in this field has supplied a method or reusable device that enables a candle maker to easily and efficiently insert a wick and guarantees that it maintains its vertical position as well as the present inventor's device.

U.S. Pat. No. 3,752,433 issued to M. R. Berman on Aug. 14, 1973, entitled "TRANSLUCENT PLASTIC CANDLE MOLD," discloses a mold comprised of a container into which wax is poured having a hole in the closed end through which the wick is passed from the bottom. The top end of the wick is attached or tied to a solid bar placed across the top of the open end of the container so that it is pulled taut. After the wax is poured and dried, the wick is untied from the bar, and the bar is then removed. While Berman is somewhat useful in maintaining the wick straight and centered, the candles in Berman are poured into jars and containers having holes through the bottom, and in addition the wick must be tied and untied from the bar on top of the jar, which can be a time costly procedure. Simply cutting the wick would also lead to wasted materials and therefore an increase in production costs.

U.S. Pat. No. 3,759,478 issued to H. A. Schmitt et al. on Sep. 18, 1973 entitled "CANDLE MOLD," discloses a method of inserting a hardened inner core into a candle mold. The inner core is centered on the candle mold by matching the hole in the candle mold up to the hole in the inner core. A wick is then strung through a small hole in the bottom of the candle mold, and is then passed through the inner core. A piece of tape is used on the bottom of the candle mold to prevent wax from spilling out the bottom of the mold. The wick is wrapped around a removable horizontal bar attached to the top of the mold. When molding of the candle is completed, the wick is detached from the bar and the candle is removed from the mold. Schmitt et al. does not teach a device for making candles in a jar or container, and in addition, manually stringing the wick through the core is a time costly procedure.

U.S. Pat. No. 3,998,922 issued to T. H. Weiss on Dec. 21, 1976, entitled "METHOD OF MAKING A CANDLE IN A CONTAINER," discloses a candle making method wherein a metal rod having a sheet metal plate detachably connected to its lower end, whereby the sheet metal plate acts as a wick base, is placed in a candle jar filled with molten wax, and the wax is left to harden. Once the wax has hardened, the rod is removed, and a wick is inserted into the hole left in the wax by the metal rod and inserted into the sheet metal plate, which lies along the bottom of the jar. A small amount of wax is then poured into the jar to hold the wick to the wax. Such method is slow and cumbersome because the wick must be manually threaded down through the candle and into the wick base, which task is inefficient and time consuming.

U.S. Pat. No. 4,004,773 issued to W. R. Binder on Jan. 25, 1977, entitled "CANDLE MOLD," discloses a mold comprised of a barrel having a removable wick base and end cap on one end. The end cap has a centrally located hole that is aligned with a hole in the wick base, which rests upon the end cap. A wick is fitted through such holes and extends upwardly into the barrel, where it is retained in a taut manner by a wick pin or holder. Wax is then poured into the barrel surrounding the taut wick, after which the wick is released from the wick holder, the flexible end cap is removed from the barrel, and the candle is pulled off the end cap. Such method is not applicable to candles formed in jars or containers.

U.S. Pat. No. 5,939,005 issued to K. C. Materna on Aug. 17, 1999, entitled "CANDLE FORMING METHOD," discloses a method wherein a wick holder and wick are positioned centrally in a candle holding container, said holder having a vertically extending sleeve around the wick. Wax is then poured into the container around the sleeve, so that the wick is centered within the sleeve, within the candle. When the wax is partially hardened, the sleeve is removed, and the molten wax then surrounds the wick. The Materna device varies from the present inventor's apparatus in that the Materna device must be removed while the wax is only partially hardened, not after the wax has completely cooled and hardened. The present inventor's wick holder or straightening device is also more efficient and easier to use because it does not need to be removed during any crucial time, since the sleeve can be removed late in the cooling stage or hours or even days after complete cooling has occurred. In addition, the Materna sleeve is open rather than closed at its upper end, so that wax can begin to seep up the wick during hardening, while the present device utilizes an automatically pressurized gas in the top of the tube to prevent such seepage, so that the sleeve does not have to be cleared or cleaned of hardened wax after each use, since wax is prevented from coming into contact with the wick during the entire curing process.

U.S. Pat. No. 6,090,331 issued to R. F. Schwarz et al. on Jul. 18, 2000, entitled "METHOD OF MANUFACTURING GEL CANDLES HAVING NON-METAL CORE WICKS," discloses a method of keeping a wick upright when it is submerged in a gel candle body. A wick clip containing a non-metal core wick is centered on the bottom of the jar or container using magnetic material ensuring that the non-metal core wick is substantially aligned with the longitudinal axis. A guide may be used to leave space for the insertion of a non-metal core wick after the gel is poured, but before it is completely cooled. The non-metal core wick is then fed through the hole left by the guide and inserted into the wick clip. Such method is similar to the previously discussed method of inserting the wick after the gel has partially solidified. Although this invention allows the wick to be centered, which is important in candle making, it does not account for the forces applied to the wick after the wax is poured, since it is designed for use with gel candles rather than wax candles.

U.S. Pat. No. 6,151,767 issued to W. Gross on Nov. 28, 2000 entitled "MAKING CANDLES," discloses a method of creating a passage within a candle through which a wick may be strung after the wax has been poured into the mold and hardened. A core element containing a rod is inserted from the lower wall of a candle mold. The wax is then poured into the candle mold and allowed to harden. The core element is then pushed up and out of the candle mold, whereafter a wick is strung through the passageway left behind by the core element. Additional molten wax is then added to fill the cavity and secure the wick in place. The presented design makes use of a core element that is removed, but it is not inserted through the bottom of a mold and removed out of the top. Instead, it is placed into a jar or container then retrieved after the wax has cured and hardened.

Although each of the above apparatus and methods may have its own utility, none of such arrangements teaches an apparatus and method for maintaining the wick of a candle straight and centered during the curing process as well as keeping the installed wick completely dry from the molten wax during the curing process in the manner of the present invention.

OBJECTS OF THE INVENTION

It is therefore a primary object of the invention to provide a device that allows a candle maker to easily and efficiently install a wick into a candle made in a jar-type container.

It is a further object of the invention to provide a device that maintains the candle wick of a candle straight during the curing process.

It is a still further object of the invention to provide a candle wick straightening device wherein there is little or no contact between the wick and the first pouring of molten wax into the jar or container.

It is a still further object of the invention to provide a candle wick straightening device which can be removed at any time after the curing and settling of the wax has occurred.

It is a still further object of the invention to provide an airtight wick protector during the pouring and curing of the first charge of wax to a container which prevents contact of molten wax with the surface of the wick while maintaining the wick straight in the container Still other objects and advantages of the invention will become clear upon review of the following detailed description in conjunction with the appended drawings.

SUMMARY OF THE INVENTION

A wick straightening apparatus is provided which includes a narrow tube or sleeve and crosspiece preferably adapted to slide up and down along the tube. The sleeve is sized to snugly fit around a wick and wick clip or holder, and the upper end of the tube is closed or airtight. The crosspiece, which slides up and down the tube, can be made in a variety of lengths or widths, but such width must be greater than the width of the jar opening, so it can rest on the jar lip while the apparatus is in use. The top portion of the crosspiece may be rounded to more ergonomically fit the design of one's hand, although the bottom portion should remain flat at least on the ends so that it rests evenly upon the jar lip. Such device is simple and easy to use and will enable a candle maker to work more quickly as compared to prior art wick straightening devices and methods. In use, first a candle maker will insert the upper end of a wick having a wick holder or clip support attached on its lower end into the wick-straightening device or apparatus. The wick apparatus is then inserted into a jar-type container filled with molten wax. After the wax cools, the wick apparatus is simply pulled out of the jar, leaving the wick and wick holder in the jar, and additional wax is then poured into the jar to fill in the concave depression that formed when the original wax cooled as well as into the area previously occupied by the wick apparatus tube or sleeve. Once such additional wax has cooled, the candle is complete with a straight wick, and the wick apparatus can then be immediately reused for the next batch of candles to be made. There is no preparation or cleaning of the wick straightener apparatus required after each use, since wax is prevented from entering the tube or sleeve, which has a closed or airtight upper end, by air trapped in the tube prior to insertion into the jar. Since the apparatus can be made out of fairly low cost materials such as plastic, candle makers can keep large quantities of them on hand and replacement costs are minimal. The wick straightener of the invention also allows the candle maker to be confident that the bottom wick tab is precisely centered by the fact that the top is of the wick straightener tube or sleeve can be visually centered, even in dark deep containers where the bottom of the jar may not be visible.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Typically, in manufacturing candles in a jar-type container, such as a glass jar having an inner wall and a floor or closed bottom, first the wick is attached on one end to a wick holder or clip, which is then situated centrally on the interior bottom of the container. Next a so-called fuel, which is formed of a wax such as paraffin, is heated and is poured into the jar or container so that the wick is surrounded by the fuel. Paraffin wax is a heavy hydrocarbon that is a solid at room temperature, but easily melted by heat, and is derived from crude oil. Unfortunately, in the typical situation, as the fuel cools and hardens, it contracts, causing the wick to be pushed and pulled in different directions resulting in it being off center in the jar or container after the fuel is solidified or hardened. Later, when the candle is used, the wax near the end of the wick is melted, which liquid wax is then absorbed by the wick and pulled upwardly by capillary attraction, so that the flame then vaporizes the wax, which wax vapor is then what is actually burned. As the wax is gradually burned away, the flame will burn lower and lower in the candle or jar. However, if the wick is not more or less positioned straight or vertically within the wax, as well as centered in the jar, the flame will be forced to burn to one side in the container. This uneven burning can have several consequences, such as the burning, or at least blackening, of one side of the glass container, or may cause the flame to be doused by the buildup of too much liquid wax around the flame, buildup of wax on the opposite sidewall of the container, possible cracking of the container, and other undesirable consequences. Thus, it is important that the wick be maintained as straight as possible during the candle curing process so that it will burn evenly when the candle is used and last longer during actual use. The present inventor has conceived of and developed a better way for keeping a candle wick straight during such process that takes advantage of the natural tendency of the wax to shrink as it hardens. Maintaining a straight wick in the container increases the safety and desirability of the final candle, since a flame in the center is less likely to get nearby objects on fire or break a glass container or the like.

Figure 1:
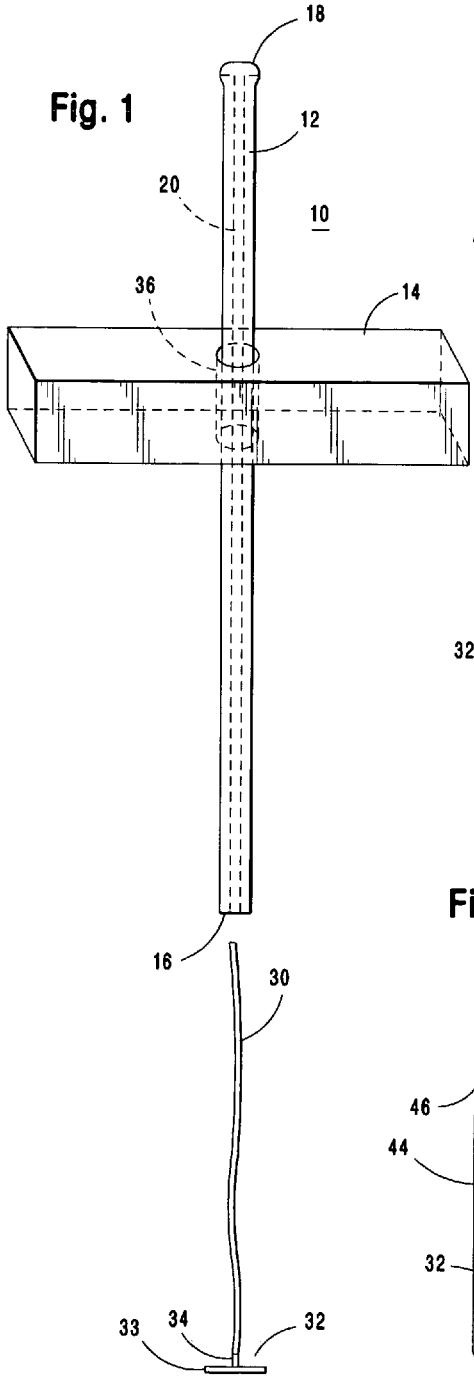
FIG. 1 is an isometric view of the wick straightening apparatus of the invention situated or shown positioned just above a candle wick which wick ultimately will be inserted into hot wax protected by the straightening apparatus of the invention.

Referring now to the drawings, FIG. 1 illustrates a preferred embodiment of the candlewick-straightening device of the invention, while FIGS. 2-6 illustrate its use. More particularly, FIG. 1 is an isometric view of a preferred embodiment of the wick straightening apparatus 10 of the invention situated just above a typical candle wick. Apparatus 10 is generally comprised of an elongated tube or sleeve 12 and a cross-piece or mounting bar 14. Sleeve 12 has a first or lower end 16, an upper or opposite end 18, and a cavity or bore 20, shown in dotted lines in FIG. 1, extending through substantially the entire length of sleeve 12. Cavity 20 is sized to closely receive or accommodate a candle wick 30 of a normal type so that the wick 30 is preferably frictionally held in cavity 20, at least to the extent it will not slide out, once entered into the cavity without being physically pulled out such as, for example, after the wax has solidified over the wick clip or holder, which serves as an anchor on the end. However, the fit of the wick in the sleeve should not be too tight or it will become too difficult to quickly insert the wick into the sleeve. Wick base 32, which is typically made from stamped metal, is comprised of a disc portion 33 and an upwardly extending hollow cylindrical portion 34 for receiving the lower end of wick 30 by a means known in the prior art, such as by clamping or threading the wick to the clip.

The requirements of the straightener tube or sleeve are that it has walls which are substantial enough in thickness to prevent warping over repeated cycles of heating and cooling, that it not be particularly "wetted" by molten wax or adherent to solidified wax, and that the inside diameter snuggly accommodate the wick in use. In this regard the wick should be easily insertable into the straightener tube and easily slidable upwardly into it, with, however, a snugness which prevents the wick from easily sliding out of the tube again as a result of the usual movements to which it may be exposed. Since, as a general rule, almost all wicks are commonly made to or with the same diameter, differing only in their other properties such as flame width and the like, one diameter of wick straightening tube will be suitable for almost all wicks. The top of the tube may be sealed against passage of air in almost any suitable manner such as, with plastics, heat sealing, dipping in a sealing compound, plugging or any other effective manner. In the drawings, the use of a plug held in place with a threaded fastener is shown. While for convenience and cost considerations a round wick tube is preferred, any other shape such as square, rectangular in general, oval or the like will be satisfactory so long as the other properties, such as diameter, wall thickness and composition are adhered to.

Figure 2:
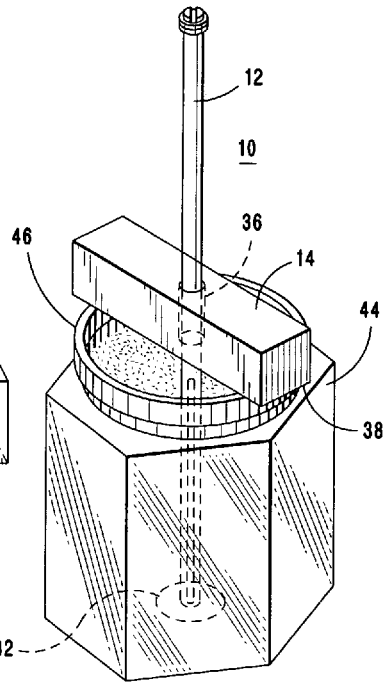
FIG. 2 is an isometric view of the wick straightening apparatus of the invention in use with a jar-type candle container.
Figure 3:
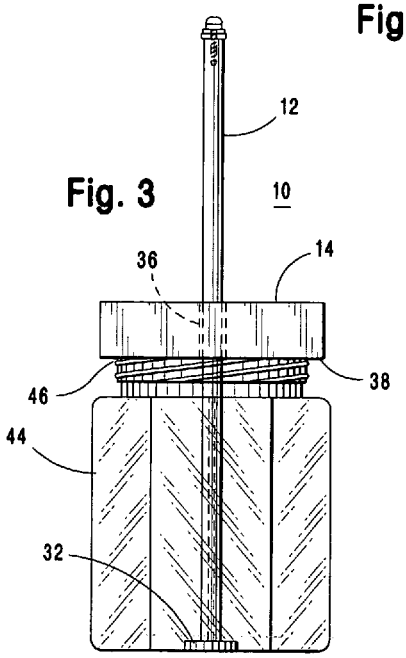
FIG. 3 is a side view of the wick straightening apparatus of the invention as shown in FIG. 2.

Crosspiece or mounting bar 14 is preferably slidably engaged with sleeve 12 through orifice 36, shown in dotted lines in FIG. 1, so that it can be easily moved upwardly and downwardly along the sleeve. However, in another embodiment, not shown, the crosspiece can be rigidly secured to sleeve 12, which might be desirable if the device 10 was only to be used in the manufacture of candles in a container having a single size or depth. In the preferred embodiment, crosspiece 14 may be disengaged from sleeve 12 by moving it downwardly until it is slipped off the lower end 16 of the sleeve. However, the upper or opposite end 18 of the sleeve preferably has a somewhat larger diameter so that crosspiece 14 cannot be removed via such end. Crosspiece 14 is essentially a block having preferably a generally rectangular shape and should be thick or wide enough so that sleeve 12 is prevented from pivoting away from a position at a right angle with respect to the crosspiece. In addition, crosspiece 14 should be at least long enough so that, as shown in FIG. 2, the edges of the bottom side 38 of crosspiece 14 can rest on the upper edge 46 of the mouth of the jar or container 44 in which the candle is to be formed, thereby supporting device 10. Finally, crosspiece 14 should have sufficient weight or density to prevent the sleeve 12 from being moved off center with respect to the jar or container as a result of the forces applied on it by the shrinking or hardening wax during the curing process, or even due to accidental bumping of the work surface or table on which the candle rests. The top side of crosspiece 14 can have different shapes, such as to conform to the hand of the user, as the shape of such side is not critical to the working of the invention. However, at least the edges of the bottom side 38 should be generally flat so that the device is supported evenly on the mouth or lip 46 of jar or container 44, although certain portions of the bottom side may be omitted in order to reduce the amount of material actually used in manufacturing the devices. If the crosspiece 14 is to be always used with the same size container, its bottom may be appropriately grooved to match the lip of the container as an aid to centering the wick.

As will be readily understood, while the crosspiece or mounting bar 14 has been described in its best and most convenient form which works very efficiently, such mounting bar is merely a convenient support for the wick straightening member and could be substituted by any other holder which will conveniently support the straightener tube at any desired point in the container. For example, if one were forming a very large candle in a wide dish or a large candle having several wicks, for example, in a row, a fixed or movable holder for the straightener tube might be used for placement of the wick and wick straightener at any given location in the wax. This is diagrammatically illustrated in FIG. 8 discussed hereinafter.

Figure 4:
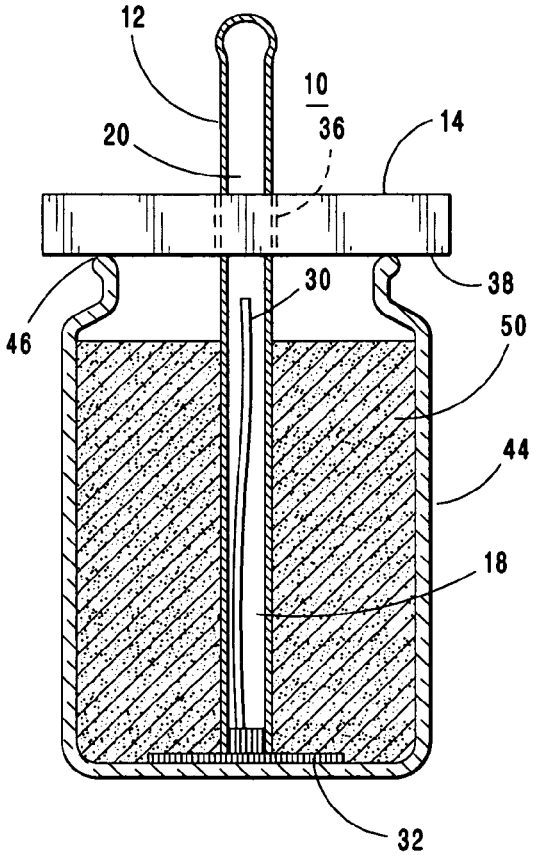
FIG. 4 is a cross-sectional view of the wick straightening apparatus of the invention in use as shown in FIGS. 2 and 3.

The wick straightening device of the invention is used as follows. Molten wax 50 is poured into the jar or container, preferably before the wick 30 has been inserted in the container so that wax will cover the bottom of the wick base 32, which helps to adhere it in place in the container. At the same time, or at an earlier or slightly later time, wick 30 is inserted into the cavity or bore 20 starting from the bottom end of sleeve 12 up to the metal base 32 so that none of the wick is protruding from cavity or bore 20 in sleeve 12. Normally, the wick will have some slight curvature in it which will aid in contacting opposite sides of the inside or interior diameter, or ID, of the straightener tube as shown in FIG. 4. As shown in FIG. 4, cavity 20 in sleeve 12 is slightly wider than is necessary in practice to illustrate such bend or kink. In practice, however, the curvature of the wick is barely noticeably, and in any event is not critical or even necessary to the invention, and furthermore does not cause the wick 30 to be moved off center with respect to the jar or container. In most cases the straightener tube will have an ID, or inside diameter, just barely smaller than the extreme OD, or outside diameter, of the wick so as explained the wick is slightly compressed and though it can be easily slid into the center of the straightener tube and will not slide out by itself, it can be easily pulled out or the straightener tube pulled off it after the first poured wax has solidified over the base.

After the wax 50 has been poured, and preferably after it starts to harden on the edges, the wick base 32, wick 30, and sleeve 12 of the straightening device 10 are placed in the wax so that the sleeve and wick extend vertically from the container. Bar or crosspiece 14 is then situated so that it is resting on the lip 46 of the container, bridging the mouth of the container. The wax is then left to harden, with the straightening apparatus in it. Liquid wax is prevented from entering cavity or bore 20 in sleeve 12 to any extent from the bottom because the top end 18 of the sleeve is closed or airtight, so that air trapped in the sleeve when the device was inserted into the wax-filled jar opposes filling with wax. In addition, the high temperature of the wax causes the air molecules in the sleeve to heat up, gaining in that way energy and causing the gas expand, thereby increasing its downward pressure on the wax. Such heating to a large extent counteracts the hydraulic compression executed by the wax upon the air trapped in the straightener tube. Likewise, wax is inhibited from being absorbed into and traveling up the wick 30 in the sleeve 12 via capillary action because of the relative viscosity of the hot wax, the narrow space, and the relatively short period to solidification. If wax traveled up the tube, it would be difficult to then remove the tube from the wick. Therefore, essentially none or very little of the wick is saturated during the first wax pouring, and the bore or cavity 20 of sleeve 12 remains essentially wax free and ready for immediate reuse.

Figure 5:
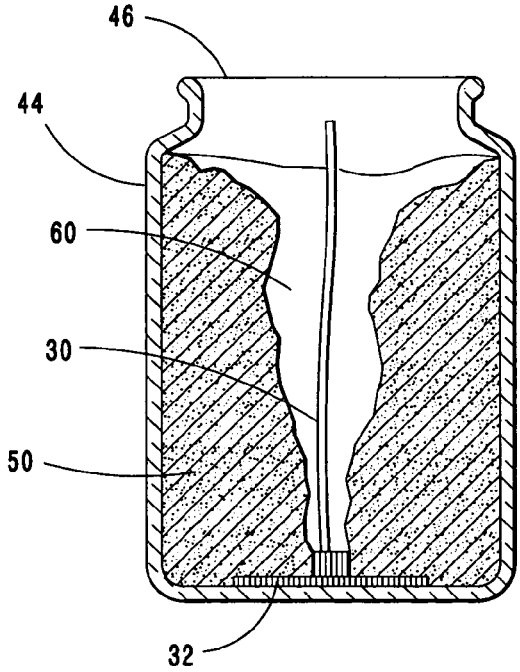
FIG. 5 is a cross-sectional view as in FIG. 4 after a first layer of molten wax has been poured and has hardened and with wick straightening apparatus of the invention removed.
Figure 6:
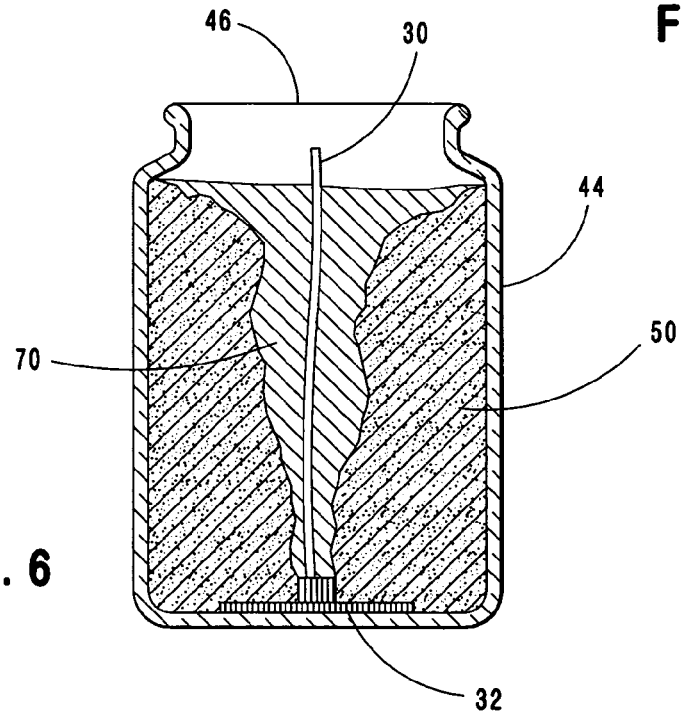
FIG. 6 is a cross-sectional view as in FIG. 4 after a second layer of molten wax has been poured to form the completed candle.

After the wax hardens, as shown in FIG. 5, the straightener device 10 is removed from the container, and the wick is left in the container surrounded by a fairly narrow but often uneven lacuna or hole 60 left by the straightening device. Note also that the overall volume of wax in the jar or container is decreased by the hardening of the wax. The wax shrinks when hardening, so that, as shown in FIG. 6, new wax 70 is then poured in the hole left by the straightener and to fill in where the shrinking occurred. Because the sleeve 12 is quite narrow, after the sleeve is removed the wick will remain substantially centered and vertically aligned in the narrow opening as the new fuel hardens around the wick. As a consequence, the forces exerted on the wick during this second pour are much less than in a full container of liquid fuel or wax. The result is a much straighter wick.

Figure 7:
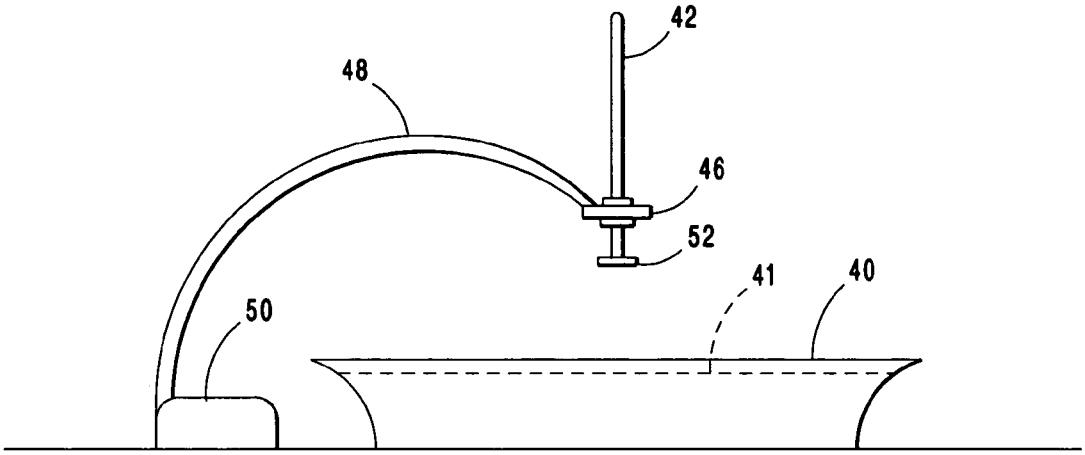
FIGS. 7 and 8 are diagrammatic side views of further embodiments of the invention.

FIG. 7 illustrates an alternative holder or support for the straightening tube during use wherein there is shown by way of example a wide comparatively shallow dish-type candle holder 40 in which a shallow bath of molten wax 41 is contained. Above such bath is shown a straightening tube 42 in accordance with the invention which, it will be understood, contains a wick. Such straightening tube 42 is supported in a frictional slide arrangement with a plastic collar 46 through which it passes. The collar 46 is supported by an arm 48 having a weighted base 50 which is supported on the same surface upon which the shallow dish candle holder is supported. It will be understood that the straightening tube 42 and contained wick may be pressed downwardly into the dish of molten wax, or, more preferably, will be pressed downwardly before the first pour of the wax into the dish so that the sick clip 52 contacts the bottom of the dish. Thereafter, the molten wax that is poured into the dish to the level desired becomes solidified, the wick straightener tube of the invention will be slid up through the collar 46, leaving a straight wick extending upwardly between uneven walls of a lacuna or opening about the wick. A second pour of wax is then made into the lacuna, or opening, about the straight wick. The second pour, being made in a relatively constricted passage in the solidified wax, does not seriously deflect the wick from its straight condition.

Figure 8:
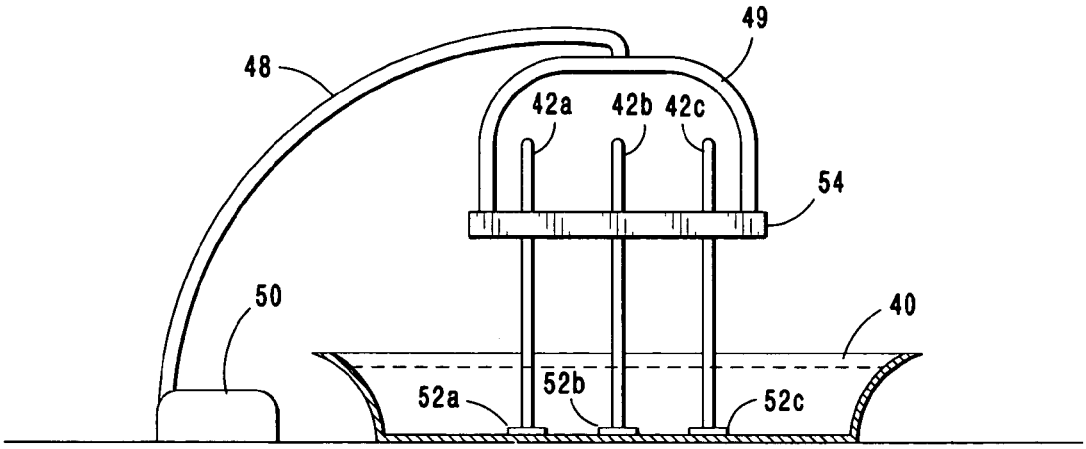

FIG. 8 shows an arrangement similar to that shown in FIG. 7, but wherein there are three straightening tubes mounted on the supporting arm 48 from an elongated bar 54 similar to the supporting bar used in applicant's primary embodiment shown in FIGS. 1 through 4 and supported from a bridging bracket 49 attached to arm 48. The three straightening tubes 42*a*, 42*b* and 42*c* are shown pushed down into the candle dish 40 to install three spaced wicks in the dish, which will then burn as separate flames. As will be understood by those skilled in the candle making art, it may be desirable to provide separations in the dish itself to separate the three ultimate wick burning areas from each other. However, this would not affect the use of the wick straightening apparatus of the present invention. It will also be recognized that while it is practical and convenient to provide a sliding support for the wick straightening tube, that any convenient effective holder can be used including clips, clamps and the like. It will be found, however, that a holder in which the straightener tube can be slid or forced downwardly by pressure executed on the top is particularly desirable from a time saving viewpoint.

The advantages of the present invention over the prior art are numerous and should be fairly evident. First, by providing a sleeve having an airtight upper end, liquid wax is prevented from covering the wick while it is in such sleeve due to the pressurized air remaining in such sleeve when the device is inserted into the poured wax, the air being pressurized by the pressure of the wax pushing up from below until an equilibrium between the hydraulic pressure of the wax and the increased pressure of the air reaches an equilibrium and the wax can no longer ascend in the tube. This enables the device to be immediately reused without requiring any additional cleaning, which can be time consuming. In addition, once the wick in the apparatus is placed in the wax containing jar, such work apparatus can be left in the jar overnight or for several days. In other words, there is no requirement that the device must be removed prior to the wax becoming completely hardened as in prior art arrangements. This allows a single worker or perhaps two workers to pour several dozen or even hundreds of candles and then insert the wicks secured in the inventor's wick straightening apparatus, leaving them to harden overnight. After the wick straightening device has been removed from each candle, the second layer of wax, or second pour, can then be immediately poured in each container. The invention results in a candle having a much straighter wick than in a conventional candle with very little additional effort and expense. While the sleeve 12 and crosspiece 14 may be made of different substances, a plastic composition capable of withstanding repeated usage in molten wax is preferred. Sleeve 12 should have a weight substantial enough so that it does not float in the molten wax, while, as indicated above, crosspiece 14 should be heavy enough to resist movement due to the forces exerted on the sleeve by the hardening and shrinking wax. In addition, sleeve 12 could have different internal dimension or cross-sectional shapes, depending upon the shape of the wick being inserted into the candle.

Other features may be added to the invention. For example, as noted above, it may be desirable to add notches or recesses on the bottom side of the crosspiece spaced apart the approximately width of the mouth of a candle jar or container. Such notches would fit into the lip of the container mouth, thereby adding protection against movement of the wick straightening device on the container caused by accidental jarring or bumping or other outside causes or vibrations. In addition, more than one crosspiece may be provided bridging the mouth of the jar or container. However, while such an arrangement might further stabilize the device on the candle jar or container, it is not believed that such further stability is necessary or even desirable, as the inventor has found the device to be sufficiently rigid or stable with a single crosspiece as described above.

In some cases, an installed wick with a curve to complement certain containers may be desired. In such case, the tube may have a deliberate curve to it. For example, in some cases, it may be desirable for the wick to conform to the contour of a curved side of the candle container, and in such cases the tube may be deliberately curved to the same contour.

Figure 10:
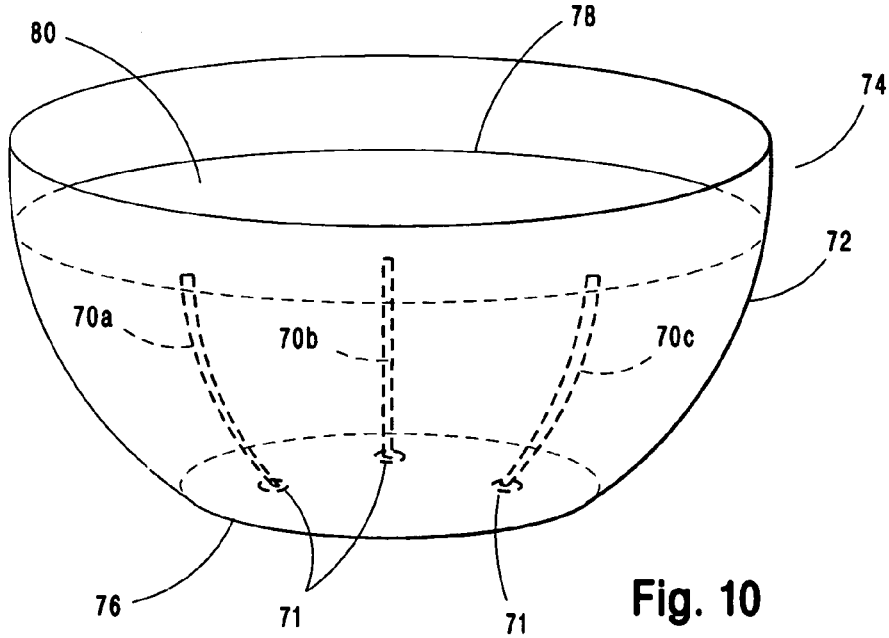
FIG. 10 is a diagrammatic side view of a further embodiment of the invention wherein wick guidance tubes are used to assist in placement of the wicks where the candle container has a smaller bottom or base than its top opening.

As an example, in FIG. 10, the candle container has a considerably smaller bottom than top, and it is desired to keep the multiple wicks more or less equivalent from the sides of the container. In such case, the wick container tubes are, strictly speaking, "guidant tubes" rather than straightening tubes. In FIG. 10, three guidance tubes 70*a*, 70*b*, and 70*c*, shown in dashed lines are spaced apart but follow the contour of the curved wall 72 of the container 74 from the bottom 76 upon which the wick clips 71 lie to the surface 78 of the molten wax 80. For convenience in illustrating the principle, no specific tube support is shown for use while the wax is molten.

Figure 9:
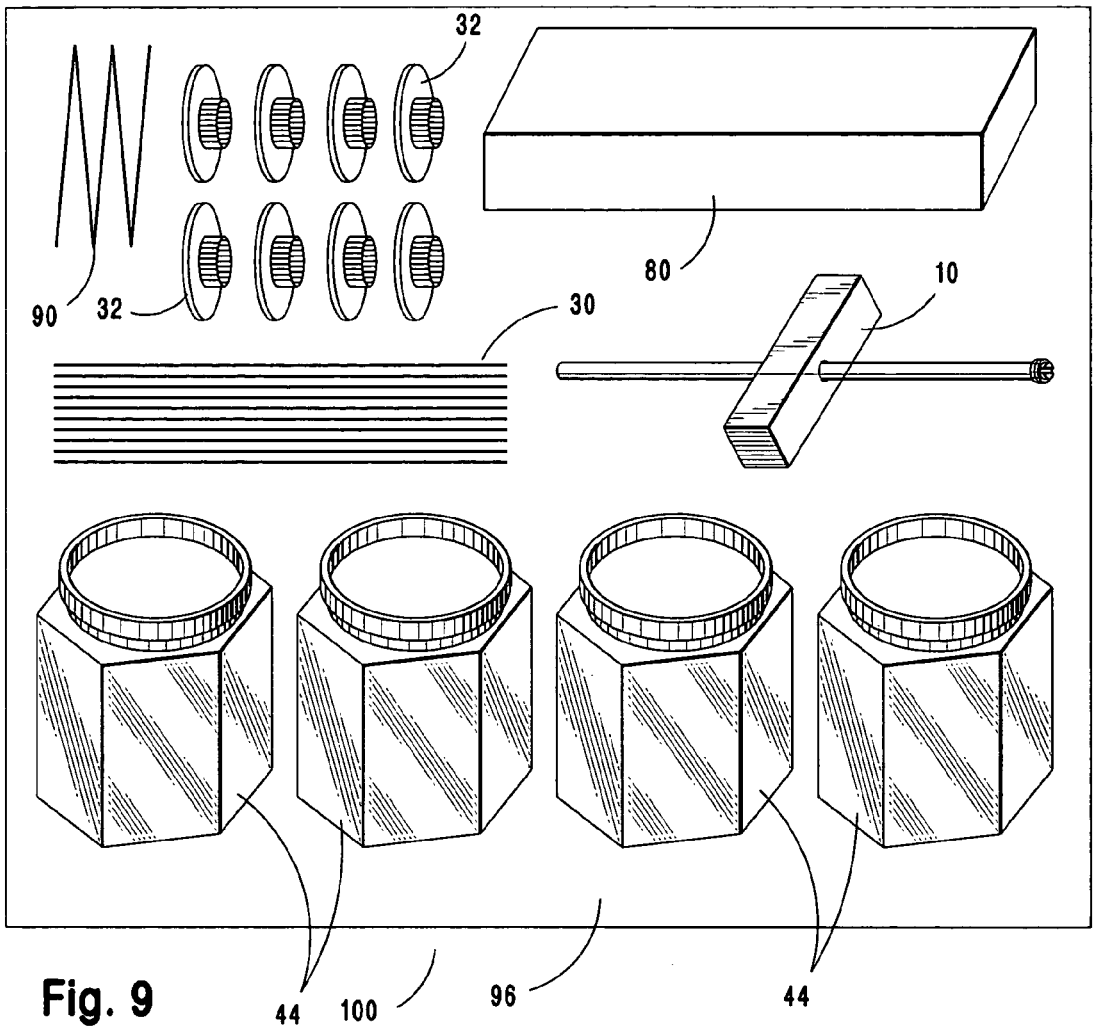
FIG. 9 illustrates a kit for carrying out the invention.

While it is believed that the present invention is particularly desirable to candle manufacturers who will be able to speed up their manufacturing process by using the invention, it is believed that consumers may also desire to use such invention in making candles at home or for recreational purposes. In anticipation of such use, FIG. 9 illustrates a kit 100 for holding the various contents required to make one or more candles using the invention. Kit 100 may include at least one wick straightening device 10, one or more containers 44, a supply of wicks 30 and wick stands 32, a block of paraffin or other wax 80, and instructions for using the wick straightening device 90. Such contents are carried in packaging 96.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A method for manufacturing a candle having a substantially straight and centered wick comprising the steps of:

(a) adding liquid fuel into a jar or container having side walls, a bottom wall, and an open mouth portion, (b) inserting a wick into the open lower end of a tubular wick enclosing means having an airtight and permanently closed upper end opposite said lower end such that the wick is substantially completely contained within the tubular wick enclosing means, and with a wick support attached to and extending from the lower end of the wick, (c) inserting the tubular wick enclosing means with the wick therein into the jar or container so that the wick support is resting on the bottom of the jar or container, and with the tubular portion of the device being held in a vertical orientation by resting within an orifice in a bar extending across and resting upon an upper lip of the jar or container, (d) after the liquid fuel has substantially hardened or settled, removing the tubular wick enclosing means from the jar or container by applying a substantially upward force on said tubular wick enclosing means, while leaving the wick in the container, and (e) pouring a further layer of liquid fuel in said jar or container.

2. The method of a claim 1 additionally comprising the step of prior to inserting the wick into the tubular portion of the device, placing a slight kink in the wick to provide better frictional engagement between the wick and the tubular portion.

3. The method of claim 1 wherein the device with the wick therein is inserted into the jar or container prior to adding liquid fuel.

* * * * *